United States Patent [19]

Rohr

[11] 4,094,302

[45] June 13, 1978

[54] FURNACE WITH HEAT STORAGE ELEMENTS

[75] Inventor: Eduard Rohr, Magenwil, Switzerland

[73] Assignee: Ed. Rohr AG, Magenwil, Switzerland

[21] Appl. No.: 708,218

[22] Filed: Jul. 23, 1976

[30] Foreign Application Priority Data

Jul. 29, 1975 Switzerland ..... 9841/75

[51] Int. Cl.[2] ..... F24H 7/04

[52] U.S. Cl. ..... 126/400; 110/322

[58] Field of Search ..... 126/375, 400, 350 R; 122/367 PF; 110/97 R; 165/9.1

[56] References Cited

U.S. PATENT DOCUMENTS

| | | | |
|---|---|---|---|
| 1,158,652 | 11/1915 | Doyle | 110/97 R |
| 1,217,551 | 2/1917 | Armor | 110/97 R |
| 1,505,120 | 8/1924 | Zuzulin | 110/97 R |
| 2,171,002 | 8/1939 | Lengyel | 126/400 |

FOREIGN PATENT DOCUMENTS

| | | | |
|---|---|---|---|
| 637,205 | 5/1950 | United Kingdom | 122/367 PF |

*Primary Examiner*—John J. Camby
*Assistant Examiner*—Larry I. Schwartz
*Attorney, Agent, or Firm*—Flynn & Frishauf

[57] ABSTRACT

A furnace, for example of the home-heating type, has heat storage elements located in a combustion gas chamber of the furnace, the heat storage elements being placed in a path of flow of combustion gases to increase flow resistance to the combustion gases. The heat storage elements are of such size that they can be inserted into the combustion gas chamber and removed therefrom through door openings normally available in the furnace, for example to change over the furnace from liquid to solid fuels, for cleaning or the like. The storage elements preferably are metal-jacketed bodies of refractory material, for example of clay. If the furnace has a water jacket for heating of water, the clay bodies are placed against the water jacket surface, with the metal jacket of the clay bodies perforated at the side facing the water jacket. A group of such heat storage elements may be commonly supported on a carrier for removal as an assembly.

12 Claims, 14 Drawing Figures

FIG.1
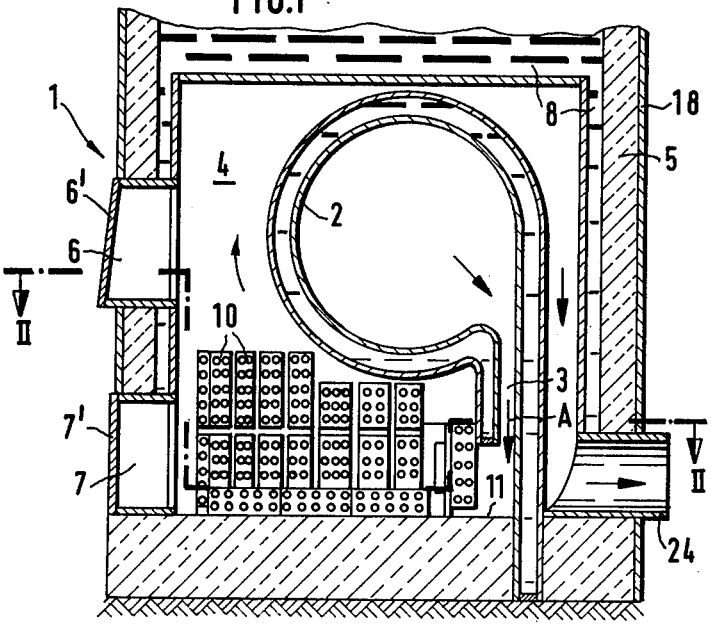
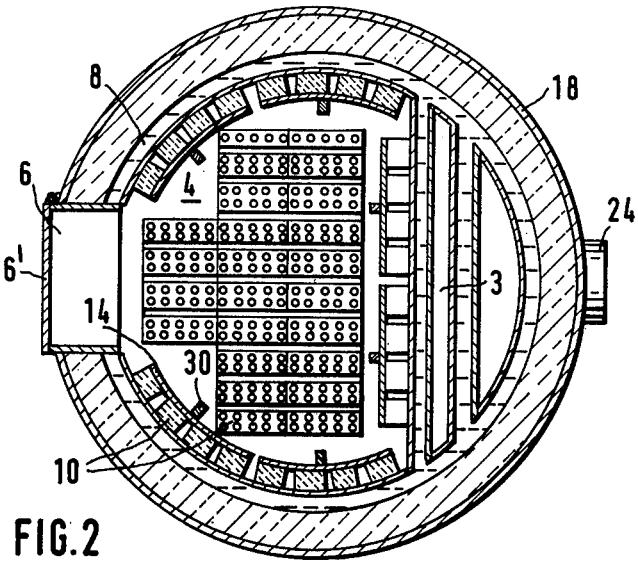
FIG.2

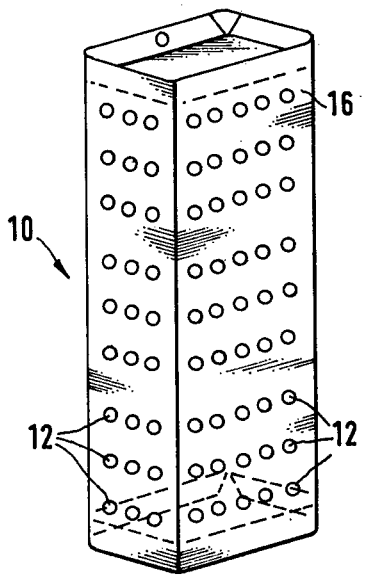
FIG. 6
FIG.7
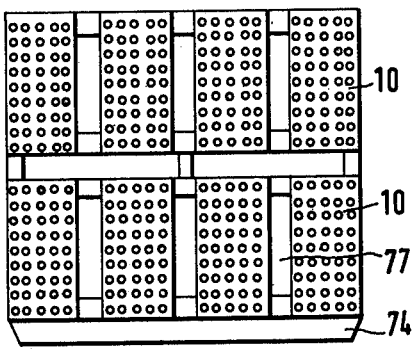
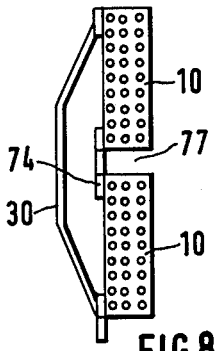
FIG.8
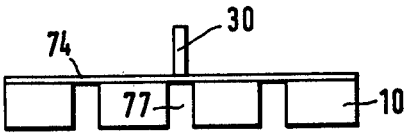
FIG.9
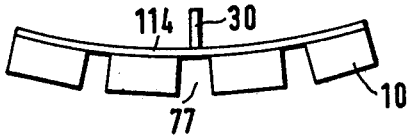
FIG.10

FIG.11
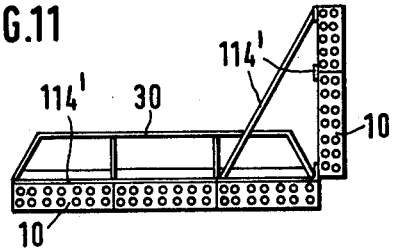
FIG.12
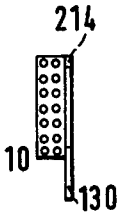
FIG.13
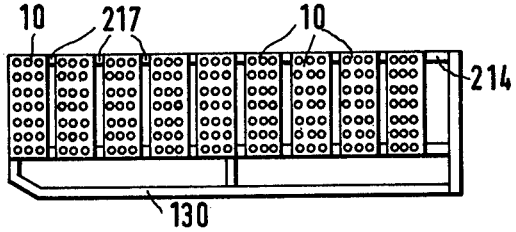
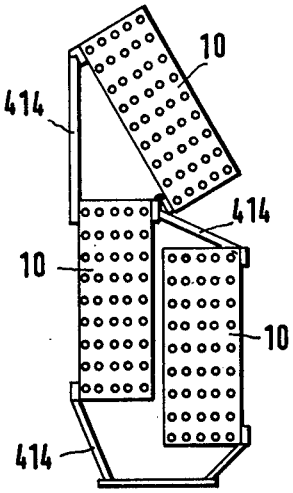
FIG.14

FURNACE WITH HEAT STORAGE ELEMENTS

The present invention relates to a boiler and furnace having a fire box and a combustion gas chamber located between the fire box and the flue, and in which the boiler-furnace combination is formed with entry openings to permit access to the interior thereof.

It is an object of the present invention to improve the efficiency of heat conversion of such boiler-furnace combinations, and more particularly of boiler-furnace combinations for use, for example, in home heating.

SUBJECT MATTER OF THE PRESENT INVENTION

Briefly, the flow resistance to combustion gases is increased in the combustion gas chamber by locating therein heat storage elements. The size of the heat storage elements is so selected with respect to the entry openings to the boiler-furnace that they can be removed singly, or as an assembly mounted on a carrier, and re-introduced thereinto through the same opening; in other words, the heat storage elements are not fixedly and removably located in the furnace.

The temperature of the combustion gases exhausted through the flue, and then through the smoke stack of the boiler unit is reduced before they reach the flue; this improves the overall combustion process and hence increases the thermal efficiency of the overall combustion and boiler unit. The heat storage elements, introduced into the combustion gas chamber thus take up some of the heat which would otherwise be wasted for release to water to be heated in the boiler when combustion is terminated. The heat storage elements, by virtue of their size related to the openings in the boiler-furnace unit, can be removed at any time, for example for cleaning or removal of soot, or if the furnace should be changed from oil or other liquid fuel to coal or solid fuel, for example. The unit is particularly applicable for intermittently fired boiler units, for example by an oil burner which is thermostatically controlled and provides, at the time of combustion, more heat than can be absorbed by water to be boiled in the furnace; this excess heat, otherwise wasted, is stored in the heat storage elements to be released to the water to be heated upon termination of operation of the burner unit.

The invention will be described by way of example with reference to the accompanying drawings, wherein:

FIG. 1 is a schematic, longitudinal sectional view through a boiler-furnace combination;

FIG. 2 is a sectional view along lines II—II of FIG. 1;

FIG. 6 is a perspective view of a single heat storage element;

FIG. 7 is a front view of a group of heat storage elements secured, as an assembly, to a carrier;

FIG. 8 is a side view of the storage elements and carrier of FIGl 7;

FIG. 9 is a top view of the assembly of FIGS. 7 and 8;

FIG. 10 is a top view of another embodiment of the invention, in which a group of heat storage elements are secured to a common support carrier, and arranged for placement against a curved wall;

FIG. 11 illustrates a modified form of a group of heat storage elements on a carrier;

FIGS. 12 and 13 are, respectively, side and front views of a group of heat storage elements on a common carrier; and FIG. 14 is a highly schematic side view of another embodiment of an assembly of heat storage elements on a carrier.

Figure 3:
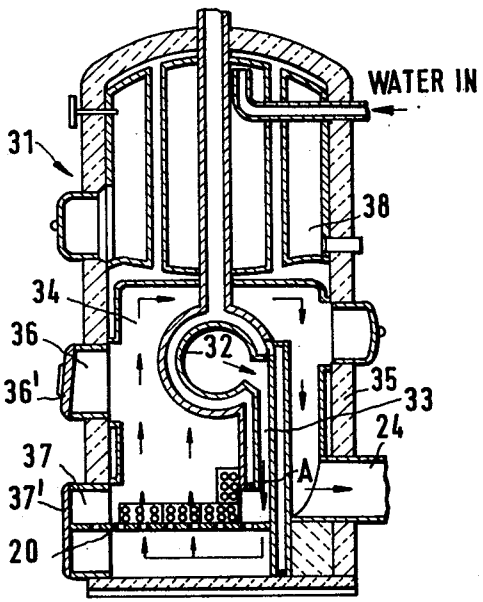
FIG. 3 is a highly schematic, vertical, sectional view showing another embodiment of a boiler-furnace combination to which the invention is applied.

The furnace and boiler unit 1 (FIGS. 1, 2) is designed to accommodate, selectively, fluid or solid fuels, for example gas, oil or coal. A fire box 2, of hollow cylindrical or rectangular shape, is located within the boiler space; actual combustion occurs within the fire box 2, particularly when the unit is fired with a gaseous or liquid fuel. An oil burner, for example, is installed at the end of the fire box 2 in conventional manner; the oil burner is not shown. The combustion gases pass, in the direction of arrows A, through combustion duct 3 into a combustion gas chamber 4 and then pass, again along the arrows, to an exhaust flue connection 24 for venting to atmosphere through a smoke stack.

The boiler has an outer metallic housing 18, an insulating layer 5 therebeneath, and a water jacket 8 inside the insulating layer 5. The water jacket 8 is to be heated by the boiler. The fire box 2 may also be surrounded by tubing conducting water, or may be formed of heat transfer elements. The boiler-furnace unit is formed with an entry opening 6, closed off by a hinged door 6', for example to solid fuel to the boiler, such as coal, wood or the like, if it is not desired to operate the furnace with liquid or gaseous fuels. An ash pit opening 7, closed off by a suitable door 7', is provided at the lower portion of the boiler-furnace unit. The two openings 6, 7 are not needed when the unit operates with liquid or gaseous fuels. The water jacket 8 surrounds both the fire box 2 as well as the combination gas chamber 4.

In accordance with the present invention, heat storage elements 10 are located within the combustion gas chamber 4. As shown in FIGS. 1 and 2, the heat storage elements partially cover floor 11 of the combustion gas chamber; and are located, partially, along the approximately cylindrical water jacket 8, at least in portions thereof. By removal of the storage elements 10, the unit can be changed over for use with solid fuels at any time. A group of the heat storage elements 10 can be combined on a carrier 14 (FIGS. 1, 2; 7–10) for insertion or removal of a group of such storage elements as a unit. The carrier 14 is preferably formed with a handle 30 for easy handling of the assembly of carrier unit 14 and heat storage elements 10.

Embodiment of FIG. 3: A grate 20 is provided to form a support surface for the heat storage elements 10. The combustion gases pass between the various heat storage elements 10 in spaces therebetween; otherwise similar parts have been given the same reference numerals as in FIGS. 1 and 2, incremented by 30.

Figure 5:
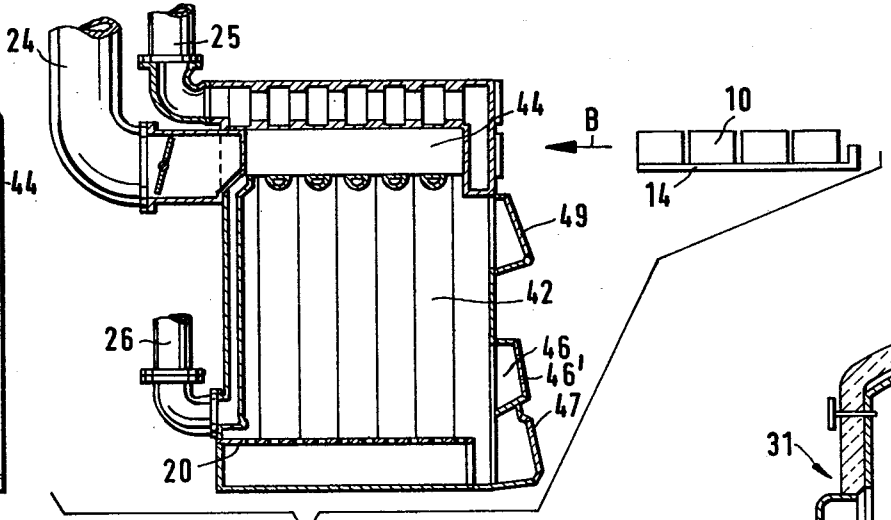
FIG. 5 is a highly schematic, vertical, cross-sectional view through the combination of FIG. 4.
Figure 4:
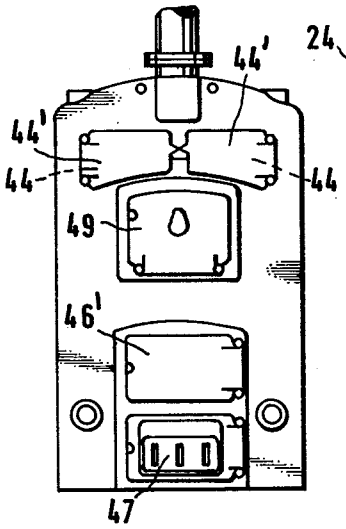
FIG. 4 is a front view of another boiler-furnace combination using the invention.

Embodiment of FIGS. 4 and 5, in which previously discussed similar elements have been given the same reference numerals, incremented by 40: The furnace is of well-known construction and formed of individual cast units, assembled together. The fire box 42 is in communication with two horizontally extending combustion gas chambers 44 closed off by doors 44'. The combustion gases then are carried to the flue through exhaust duct 24. Inlet and outlet pipes 25, 26 supply and remove the water to be heated. The furnace unit has an upper access opening 49 to provide access to an intermediate portion of the combustion gas chamber 44. Solid fuel is introduced through opening 46, closed off by door 46'. A grate 20 is provided to hold the solid fuel, and an ash removal opening is located in the outer housing, closed off by door 47. Heat storage elements 10, for example assembled on a carrier 14, are introduced horizontally in the interior of the combustion gas chambers 44 in the direction of the arrow B.

The heat storage element, individually, is best seen in FIG. 6. A metallic jacket 16, formed with holes 12, surrounds a foraminous or stone-like, compact mineral mass of high clay content, or other suitable refractory material. The heat storage element 10 is essentially rectangular in shape; suitable outer dimensions are approximately 15 × 6 × 4 cm. The openings 12 formed in the jacket 16 may extend throughout the jacket; if the metal jacket is perforated only through a part of its overall surface — which facilitates cleaning — then the unit should be so assembled in the furnace that the openings 12 are directed to fit against the wall of the furnace which is formed by the water jacket. Thus, and referring again to FIG. 1, the openings would be located at the outer circumference of the units 10 placed on a curved carrier 14 against the interior surface of the water jacket 8.

A group or assembly of storage elements 10 are secured to a common carrier 14. The common carrier 14 may have various forms, as specifically illustrated in FIGS. 7–14. The size of the individual heat storage elements 10, or of the entire group or assembly, respectively, is so selected that it can be introduced through any one of the openings 6 or 7 (FIGS. 1, 2); 36, 37 (FIG. 3); 44, 46 (FIGS. 4, 5) by opening the respective door after the complete furnace-boiler unit has been assembled and, for example, also installed. Preferably, the heat storage elements, singly or as a group on the carrier 14, is introduced through the respective combustion gas chamber door into the combustion chamber; the heat storage elements, singly or as a group, of course can similarly be removed for cleaning or change-over of fuel.

Embodiment of FIGS. 7–9: A carrier 74, of sheet metal, is provided to locate a group of heat storage elements 10 thereon. FIG. 10 illustrates a carrier which, generally, is similar to that of FIGS. 7 to 9, except that the base is curved.

The separate heat storage unit 10 is secured to the carriers 14, 74, 114, respectively, by welding, for example spot-welding at the edges or corners. The curvature of carrier 114 (FIG. 10) is selected to fit, at least approximately, the inner curved wall of the outer jacket 8 (FIGS. 1, 2) for introduction of the heat storage elements 10 in a group within the exhaust gas chamber 4. The handle 30 is attached to the rear of the carrier 14, 74, 114.

FIG. 11 illustrates a carrier unit 114' for individual heat storage elements 10 particularly appropriate for the furnace-boiler unit illustrated in FIG. 3. The carrier 114' secures heat elements 10 in horizontal as well as in vertical position. The dimensions are so selected that the carrier 114', with the individual heat storage elements 10 secured thereto, can be introduced as a unit through opening 36, or, if desired, through opening 37, and can likewise be removed through one of the respective openings.

The heat storage elements can be located on the carrier in various ways. As illustrated in FIGS. 12 and 13, the arrangement is so made that carrier 214 holds a group of heat storage elements in a row, next to each other. The heat storage elements 10 are separated from each other by respective spaces 217; similar spaces 77 are also shown in FIGS. 7–10, provided and located in such a manner that the combustion gases can readily flow around the individual heat storge elements 10 to transfer as much heat thereto as possible. The structure of FIGS. 12 and 13, particularly adapted for the embodiment of the furnace-boiler units of FIGS. 4 and 5, can be introduced thereinto by holding the handle 130 and sliding the unit in the direction of arrow B; the handle 130 may, additionally, form a support surface for the assembly of the units 10.

If the combustion chamber 4 (FIG. 1) is large, for example in structures of the boiler-furnace unit similar to those illustrated in FIGS. 1 and 2, a plurality of heat storage elements 10 can be located adjacent each other on a single carrier 414, as shown in FIG. 14. The individual heat storage elements provide, themselves, structural support for the individual sheet metal elements of carrier 414, as clearly apparent from the end view of FIG. 14. Various shapes and constructions can be made by building up the individual heat storage elements 10 in suitable shapes and forms to fit the respective combustion gas chamber, while still maintaining the overall dimension such that the unit, when assembled, can be introduced through one of the openings always found on such furnace-boiler units.

The combustion gases will meet an increased flow resistance in the combustion gas chamber, as compared with the chamber before the heat storage units have been introduced thereto, or as compared with a conventional furnace-boiler unit of the prior art. The heat storage units 10, made of material which cannot burn and which has a high thermal capacity, are heated by the hot combustion gases flowing therearound; in the gaps between firings of a burner (not shown), for example, between operation of an oil burner, heat is released by the heat storage unit to the water in the water jacket and to the space surrounding the heat storage units. The temperature of the exhaust gases from the unit, with the heat storage elements 10 therein, is less than that if the heat storage elements are not used, or have been removed. Due to the blockage of the free flow of hot exhaust gases, and reduction of the exhaust gases escaping through the flue, the overall combustion in the fire box 2, or firing space, is improved. It has been found in actual experiments and in comparative tests that the ON periods of intermittently operating, thermostatically controlled oil burners are less than those in similar furnaces which do not have the heat storage elements 10, thus saving combustion material and hence energy. The decrease in oil consumption by use of additional heat storage elements was substantial.

Various changes and modifications may be made within the scope of the inventive concept.

I claim:

1. Furnace and boiler unit having a housing (18), a fire box (2) within the housing, an exhaust connection (24) leading from the housing, and a combustion gas chamber (4) located in the housing, openings (6) formed in the housing and providing access to the combustion gas chamber, and doors (6', 36', 44', 46') closing off the openings, and comprising heat storage elements (10) located in the combustion gas chamber (4, 34) and positioned therein in the path of flow of the combustion gases to increase the flow resistance to the combustion gases, said heat storage elements (10) having a size which is smaller than the largest opening (6: 36, 37, 44, 46) providing access to the combustion gas chamber (4, 34) to allow introduction and removal of the heat storage elements (10) into and from the combustion gas chamber (4, 34), the heat storage elements (1) including a metallic housing (16) formed with openings (12) in at least a portion thereof, and a compact mineral material of high thermal capacity located within said metallic housing (16).

2. Unit according to claim 1, wherein a carrier (14, 74, 114, 114', 214, 414) is provided, and a plurality of heat storage elements (10) are secured to the carrier, the carrier being of metal.

3. Unit according to claim 1, wherein the heat storage elements are essentially rectangular in cross section.

4. Unit according to claim 1, wherein the heat storage elements (10) are located along the bottom (11) of the combustion gas chamber (4, 34) and along the lateral walls (8) of the combustion gas chamber (4, 34).

5. Unit according to claim 1, wherein a plurality of heat storage elements are located in the combustion gas chamber (4, 34), the heat storage elements being arranged therein with gaps (17; 77, 217) between the individual heat storage elements to permit the passage of combustion gases therebetween for heat exchange between the combustion gases and the heat storage elements.

6. Unit according to claim 1, comprising a water jacket (8) at the interior wall of the housing (18), the openings formed in the metallic housing of the heat storage elements being located adjacent the inner wall of said water jacket.

7. Unit according to claim 1, wherein a grate (20) is provided within the furnace and boiler unit; a plurality of heat storage units are provided, located on said grate, and spaced from each other leaving gap (77, 217) between the heat storage elements for passage of the combustion gases therebetween.

8. For combination with a furnace and boiler unit as claimed in claim 1 a plurality of heat storage elements (10) and a metallic carrier (14; 74, 114, 214, 414) holding said plurality of heat storage elements in predetermined position, and a handle (30) attached to said carrier for readily handling the assembly of the carrier and the plurality of heat storage elements (10).

9. Unit according to claim 1, wherein a plurality of individual heat storage elements (10) are provided;

a metallic carrier (74, 114, 214, 414) to which individual heat storage elements of said plurality are attached, the heat storage elements being secured to said carrier while leaving gaps (77 217) therebetween, and a handle (30) formed on the carrier.

10. Unit according to claim 9, wherein the plurality of heat storage units (10) on the carrier are located at the bottom (11) of the combustion gas chamber.

11. Unit according to claim 9, wherein the plurality of heat storage elements is located along the lateral side walls of the combustion gas chamber, the perforations in the metallic housings of the heat storage elements, at least in part, facing the inner wall of the housing.

12. Furnace and boiler unit having a housing (18), a fire box (2) within the housing, and a combustion gas chamber (4) located in the housing, a water jacket at the interior of said housing, a passage to exhaust the combustion products from the combustion chamber, openings (6) formed in the housing and providing access to the combustion gas chamber, and doors (6', 36', 44', 46') closing off the openings, and comprising heat storage elements (10) located in the combustion gas chamber (4, 34) and positioned therein in the path of flow of the combustion gases, said heat storage elements (10) having a cross section which is smaller than the cross section of the largest opening (6; 26, 37, 44, 46) providing access to the combustion gas chamber (4, 34) to allow introduction and removal of the heat storage elements (10) into and from the combustion gas chamber (4, 34), a carrier (14, 74, 114, 114', 214, 414), and a plurality of heat storage elements (10) secured to the carrier, the carrier being of metal, each heat storage element (1) comprising a metallic housing (16) formed with openings (12) in at least a portion thereof, and a compact mineral material of high thermal capacity located within said housing (16), the plurality of heat storage elements being located along the lateral side walls of the combustion gas chamber, the perforations in the metallic housings of the heat storage elements, at least in part, facing the inner wall of the housing.

* * * * *